United States Patent [19]

Pittman

[11] Patent Number: 4,502,221

[45] Date of Patent: Mar. 5, 1985

[54] LOCKING KNIFE WITH THUMB LATCH

[76] Inventor: Leon M. Pittman, Rte. 1, Box 67, Pendergrass, Ga. 30567

[21] Appl. No.: 490,192

[22] Filed: Apr. 29, 1983

[51] Int. Cl.[3] ..... B26B 1/04

[52] U.S. Cl. ..... 30/160; 30/161

[58] Field of Search ..... 30/161, 160, 159, 158

[56] References Cited

U.S. PATENT DOCUMENTS

| | | | |
|---|---|---|---|
| 4,148,140 | 4/1979 | Lile | 30/161 |
| 4,170,061 | 10/1979 | Henry | 30/160 |
| 4,177,560 | 12/1979 | Sakurai | 30/160 |
| 4,439,922 | 4/1984 | Sassano | 30/161 |

*Primary Examiner*—Jimmy C. Peters

*Attorney, Agent, or Firm*—James B. Middleton

[57] ABSTRACT

A locking knife having a thumb latch for release. The knife includes a handle, and the handle defines a cavity to receive the blade so the knife can be closed. A circular cam is fixed to the handle, and the blade has a circular hole to receive the cam, the blade being rotatable about the cam. A latch arm is pivoted with respect to the blade, and a cam follower depends from the latch arm and rides on the cam. A spring urges the cam follower towards the cam, and when the cam follower falls into the notch the blade is prevented from rotating with respect to the cam.

11 Claims, 4 Drawing Figures

Fig. 1
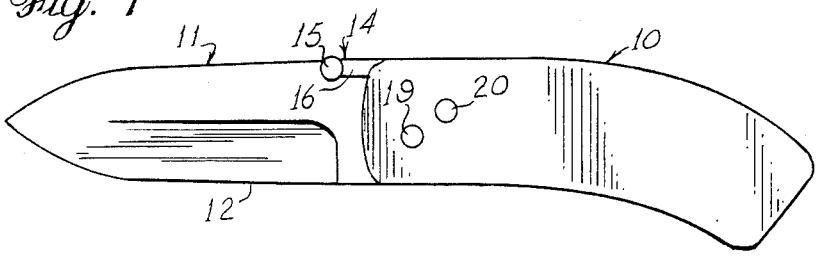
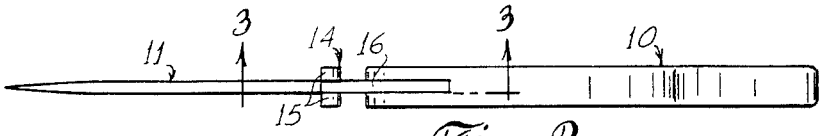
Fig. 2
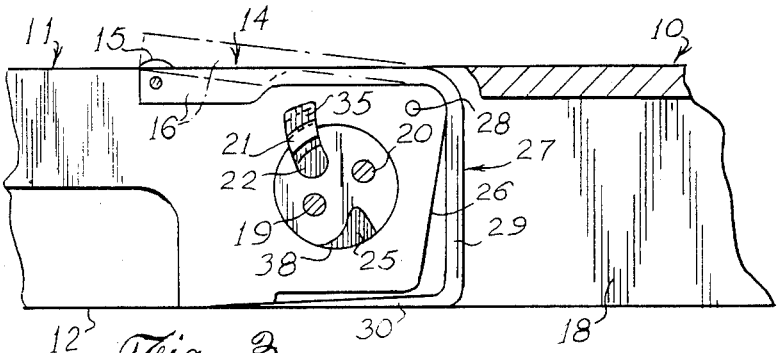
Fig. 3
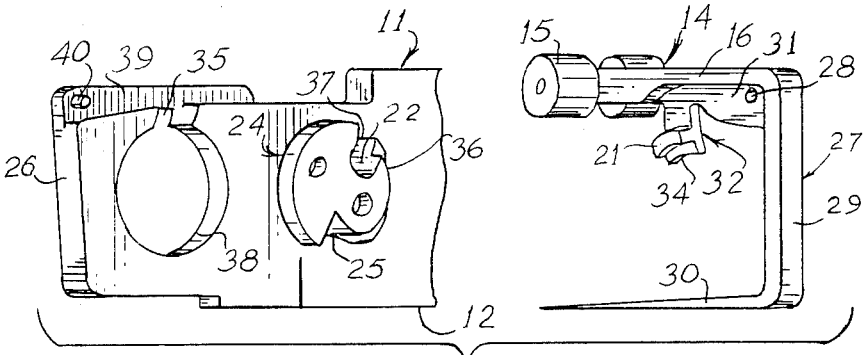
Fig. 4

LOCKING KNIFE WITH THUMB LATCH

INFORMATION DISCLOSURE STATEMENT

There are many forms of knives that lock, especially in the open position. Many such knives utilize elaborate catch arrangements and the like, and are adapted only for individual manufacture, virtually by hand. While these knives are used as collectors items and the like, it is impractical in many cases to attempt to mass manufacture such knives. Further, the catches for locking knives are most often in the form of a hook that engages a notch in the blade when the knife is open, and a release means is provided to remove the hook from the notch in order to close the knife. Such arrangements generally require that the operating mechanism be largely visible, which may cause the knife to be somewhat unsightly as a collectors item, and is subject to being fouled as a utilitarian knife.

SUMMARY OF THE INVENTION

This invention relates generally to locking knives, and is more particularly concerned with a locking knife having a thumb release, the locking mechanism being completely enclosed.

The present invention provides a knife having a cam member stationary with respect to the handle of the knife, and a cam follower carried by the blade of the knife for rotation with the blade. A thumb latch is pivoted with respect to the blade, and carries the cam follower so the cam follower can be selectively held by means of the thumb latch. Notch means are provided on the cam for locking the knife blade with respect to the cam, and additional notch means are provided in the cam to serve as a stop when the knife blade is rotated to the closed position. In one embodiment of the present invention, the cam acts as the bearing means to provide for rotation of the knife blade.

BRIEF DESCRIPTION OF THE DRAWINGS

These and other features and advantages of the present invention will become apparent from consideration of the following specification when taken in conjunction with the accompanying drawings in which:

FIG. 1 is a side elevational view of a knife made in accordance with the present invention, the knife being shown in the open position;

FIG. 2 is a top plan view of the knife shown in FIG. 1;

FIG. 3 is an enlarged cross-sectional view taken substantially along the line 3—3 in FIG. 2; and, FIG. 4 is an exploded view showing the operating mechanism of the knife illustrated in FIGS. 1, 2 and 3.

DETAILED DESCRIPTION OF THE EMBODIMENT

Referring now more particularly to the drawings, and to that embodiment of the invention here presented by way of illustration, it will be seen that the knife shown in FIG. 1 includes a handle generally designated at 10 and a blade generally designated at 11. The blade 11 has a sharp edge 12 which is designed to be received by the handle 10 when the blade 11 is pivoted to the closed position. At the back of the blade and adjacent to the handle 10, there is a thumb latch generally designated at 14. The latch 14 includes projections 15 to render the latch easy to manipulate, and includes a latch arm 16 which will be discussed in more detail hereinafter.

Looking at FIG. 2 of the drawings, it will be seen that the latch arm 16 extends rearwardly into the handle 10; and, the extending end of the latch arm 16 carries the projections 15, there being a projection to each side of the knife blade 11.

Attention is directed to FIG. 3 of the drawings for a full understanding of the construction of the knife of the present invention. It will be seen that the illustration in FIG. 3 is a cross-sectional view showing the blade in elevation, with half of the handle 10 cut away to show the blade receiving cavity 18 of the handle 10. In FIG. 3 it will also be recognized that there are two pins 19 and 20 that pass through the handle 10 to hold the blade in place, these pins 19 and 20 also being shown in FIG. 1 of the drawings to illustrate their location.

In FIG. 3 there is shown the locking portion 21 of the cam follower in locking position within a notch 22 in the cam 24. The cam 24 is held by the pins 19 and 20; therefore, it will be understood that the cam 24 is stationary with respect to the handle 10.

As will be discussed more fully hereinafter, the cam follower is carried by the latch arm 16 so that, as the latch arm 16 is moved upwardly to the position shown in broken lines, the locking portion 21 is also moved upwardly to the position shown in broken lines. At this point, the locking portion 21 is received completely within a notch in the blade 11 so the blade 11 is free to rotate about the cam 24. Such rotation can continue until the locking portion 21 reaches the notch 25 which acts as a stop means.

To render the latch 14 pivotal, it will be seen that the latch arm 16 continues to the rear end 26 of the knife blade 11 and is pivoted to the knife blade 11 at 28. The latch arm 16 is continuous with a spring member 27 having a transverse section 29 and a final tail piece 30. It will be seen that the tail piece 30 merges into the lower edge of the knife blade 11.

Attention is next directed to FIG. 4 of the drawings for a complete understanding of the construction of the parts. Looking first at the right-hand side of FIG. 4, it will be seen that the latch 14 with its spring 27 is shown. Here it will be seen that the latch arm 16 is the same width as the knife blade 11, as is shown in FIG. 2 of the drawings, but the latch arm 16 is partially cut away, or recessed, to provide a web 31. This web 31 includes the pivot 28 which is here shown as a hole through the web 31.

It will also be seen that the web 31 extends downwardly to provide the cam follower generally designated at 32, the previously described locking portion 21 being a portion of the entire cam follower 32. It will now be seen that the cam follower 32 extends downwardly to provide a holding portion 34 while the locking portion 21 extends from the side of the cam follower 32.

Looking at the cam 24 in FIG. 4 of the drawings, it will be seen that the notch 22 is a notch completely through the periphery of the cam 24 in order to receive the entire cam follower 32. As a result, when the cam follower 32 is within the notch 24, the cam follower 32 is at its lowest position, which places the locking portion 21 generally on the line between the cam 24 and the blade 11 as is shown in FIG. 3 of the drawings in full lines. Since the knife blade 11 must rotate with respect to the cam 24 to close the knife, it will be seen that the locking portion 21 effectively locks the knife blade in position.

Those skilled in the art will understand that the locking portion 21 could be fully received within the notch 22, and the blade would still be held; however, the stress would be between the locking portion 21 and the pivot 28. However, by placing the locking portion 21 in the position shown in FIG. 3, the stress is a shear force on the locking portion itself. Thus, great strength is achieved, and the locking portion 21 can be a close fit to prevent play in the blade when the knife is open.

When the latch arm 16 is pivoted upwardly, it will be seen that the cam follower 32 pivots about the hole 28 to move the locking portion 21 into the notch 35 of the blade 11, thereby allowing the blade 11 to rotate. Once the blade 11 rotates to the point that the holding portion 34 of the cam follower 32 is resting on the holding surface 36, it will be seen that the locking portion 21 is held up so the knife blade 11 can continue to rotate without further pressure on the latch arm 16.

Still looking at the cam 24 in FIG. 4 of the drawings, it will be seen that the cam surface 36 ends at the notch 25 so that, when the blade 11 reaches the fully closed position, the cam follower 32 will fall into the notch 25 to allow the latch arm 16 to resume its original position generally contiguous with the upper edge of the knife blade 11. As here shown, it will be seen that one could open the knife by simply pulling on the blade and causing the cam follower 32 to ride over the surface of the notch 25 and onto the holding surface 36. It will of course be understood by those skilled in the art that a discrete notch similar to the notch 22 could be provided so the knife would be firmly locked in the closed position as well as in the open position.

Considering now the knife blade 11 in FIG. 4 of the drawings, it will be seen that the knife blade 11 includes an opening 38 for receiving the cam 24. The opening 38 is sized to receive the bearing surface 37 of the cam 24 to allow smooth rotation of the blade 11 on the cam. Adjacent to the upper edge of the blade 11, the blade is cut away to provide an extending flange 39 which mates with the web 31 of the latch 14. It will be seen that the flange 39 includes a pin 40 extending therefrom and adapted to be received within the hole 28. Also, the surface of the blade 11 is milled out to allow the cam follower 32 to extend downwardly to engage the cam 24.

From the foregoing, it should now be understood that the knife of the present invention includes a relatively simple mechanism that can be used on many types and styles of knives. It will be understood that the knife of the present invention would readily lend itself to mass manufacture, while it is also readily adaptable to individual manufacture and assembly. The blade 11 can be made in any shape or style as desired, the only requirement for the apparatus of the present invention being the arrangement of the end of the blade to be mounted on the handle. Also, the blade 11 includes the hole 38 and flange 39, and this can readily be placed together with a cam 24 and the latch assembly 14 having the integral spring 27. These pieces can be assembled, and this assembly can be placed into a handle 10, then the pins 19 and 20 put into place, and the knife is completed. It will be understood that, when the knife is open and locked, only movement of the latch 14 will allow the knife to close, and the latch 14 is operated by a definite motion in the direction of opening the knife. As a result, there is little likelihood that one will inadvertently close the knife while the knife is in use.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or the scope of the invention as defined in the appended claims.

I claim:

1. A locking knife, including a blade, a handle defining a blade receiving cavity, said blade being pivotally carried by said handle to be selectively received within said cavity, characterized by a cam fixed with respect to said handle, an opening defined in said blade for receiving said cam therein, a latch arm pivotally carried by said blade, a cam follower fixed to said latch arm for engaging said cam, spring means for urging said cam follower towards said cam, a locking portion defined on said cam follower, said cam defining a locking notch therein, said locking notch of said cam being alignable with a notch in said blade, said notches being aligned when said knife is open so that said locking portion of said cam follower is positioned in said notches to prevent rotation of said blade with respect to said cam.

2. A locking knife as claimed in claim 1, said notch in said blade being of such size as to receive said locking portion of said cam follower, said latch arm being pivotable to move said locking portion into said notch in said blade to allow said blade to pivot with respect to said cam.

3. A locking knife as claimed in claim 2, said cam defining a holding surface, said cam follower defining a holding portion, said holding surface of said cam being concentric with the path of rotation of said knife blade and of such size as to receive said holding portion of said cam follower and hold said locking portion within said notch in said blade.

4. A locking knife as claimed in claim 3, said cam defining a second notch therein, said second notch being located to receive said cam follower when said blade is received within said blade receiving cavity.

5. A locking knife, including a handle defining a blade receiving cavity, and a blade pivotally carried at one end of said handle, characterized by a cam fixed at said one end of said handle, said cam having a generally circular configuration, a generally circular opening defined in one end of said blade, said opening in said blade receiving said cam so that said blade pivots around said cam, and latching means carried by said blade for selectively fixing said blade to said cam for locking said knife, said latching means including a cam follower, spring means for urging said cam follower towards said cam, said cam follower including a locking portion, said cam defining a notch therein, said notch in said cam being located to receive said locking portion of said cam follower for locking said blade with respect to said cam.

6. A locking knife as claimed in claim 5, said latching means further including a latch arm pivotally carried by said blade, said cam follower being fixed to said latch arm, said blade defining a notch therein for receiving said locking portion of said cam follower when said latch arm is pivoted to remove said locking portion from said notch in said cam.

7. A locking knife as claimed in claim 6, said cam defining a bearing surface cooperable with said opening in said blade for allowing said blade to rotate around said cam, said cam further defining a holding surface concentric with said bearing surface, said cam follower including a holding portion, said notch in said cam being in both said bearing surface and said holding surface for receiving both said locking portion and said holding portion.

8. A locking knife as claimed in claim 7, said notch in said blade being of such size as to receive said locking portion when said latch arm is pivoted for allowing said blade to rotate with respect to said cam, said holding portion of said cam follower being received on said holding surface of said cam on rotation of said blade for retaining said latch arm in the pivoted position.

9. A locking knife as claimed in claim 8, said cam defining a second notch located to receive said cam follower when said blade has been rotated to be received within said blade receiving cavity, said second notch receiving both said locking portion and said holding portion.

10. A locking knife as claimed in claim 7, said latch arm being normally urged to rest against said blade for limiting motion of said latch arm, said locking portion being so located with respect to said latch arm that said locking portion is disposed generally at said bearing surface so that said locking portion is received partially within said notch in said cam and partially within said notch in said blade.

11. A locking knife as claimed in claim 9, said spring means comprising a first spring portion integral with said latch arm and extending angularly therefrom to engage the extreme end of said blade, and a second spring portion extending generally parallel to said latch arm and engaging the opposite edge of said blade.

* * * * *